US006895842B2

(12) United States Patent
Magnusson

(10) Patent No.: US 6,895,842 B2
(45) Date of Patent: May 24, 2005

(54) CUTTER

(75) Inventor: Birgir Magnusson, Billnäs (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 10/600,448

(22) Filed: Jun. 20, 2003

(65) Prior Publication Data

US 2004/0255472 A1 Dec. 23, 2004

(51) Int. Cl.[7] ..... B26F 1/14
(52) U.S. Cl. ..... 83/13; 30/363
(58) Field of Search ..... 30/358, 363, 364; 83/13

(56) References Cited

U.S. PATENT DOCUMENTS

| | | | | | |
|---|---|---|---|---|---|
| 1,123,419 | A | * | 1/1915 | Stevens | 30/358 |
| 2,185,005 | A | | 12/1939 | Wagner | 164/120 |
| 2,227,575 | A | | 1/1941 | Eliel et al. | 164/86 |
| 2,424,539 | A | * | 7/1947 | Bishop | 30/358 |
| 2,558,567 | A | | 6/1951 | Kaeser | 164/91 |
| 2,598,042 | A | | 5/1952 | Dritz | 164/119 |
| 2,708,812 | A | | 5/1955 | Nakai | 47/9 |
| 3,303,564 | A | * | 2/1967 | Hendricks | 30/358 |
| 4,124,937 | A | | 11/1978 | Gaughf, Jr. | 30/229 |
| 4,669,191 | A | | 6/1987 | Schramm | 30/358 |
| 5,052,258 | A | | 10/1991 | Hunter | 83/589 |
| 5,251,378 | A | | 10/1993 | Ayer et al. | 30/205 |
| 5,638,730 | A | * | 6/1997 | Karlis | 83/167 |
| 5,647,278 | A | | 7/1997 | Wu | 101/368 |
| 5,768,370 | A | | 6/1998 | Maatta et al. | 379/433 |
| 5,995,854 | A | | 11/1999 | Wilson | 455/575 |
| 6,563,927 | B2 | | 5/2003 | Mote et al. | 379/433.11 |
| 2001/0045018 | A1 | | 11/2001 | Nichols et al. | 30/286 |
| 2002/0062567 | A1 | | 5/2002 | Nichols et al. | 30/294 |

OTHER PUBLICATIONS

Nokia User's Guide Nokia 2100, Issue 1, Jun., 1998, p. 17.

* cited by examiner

*Primary Examiner*—Charles Goodman
(74) *Attorney, Agent, or Firm*—Harrington & Smith, LLP

(57) ABSTRACT

A cutter for cutting a predetermined shaped piece from a material, such as paper, is disclosed. In one embodiment, the cutter comprises a middle, rigid cutter member and an outer, flexible non-cutting jaw member. The jaw member comprises a pair of elongated arms, a first arm and a second arm, which are joined together at a connected end. The cutter further includes an attachment member for attaching the connected end of the non-cutting jaw member to the middle, rigid cutter member.

29 Claims, 9 Drawing Sheets

CUTTER

BACKGROUND OF THE INVENTION

1. Field of the Invention

The present invention relates to cutting devices and, more particularly, to a cutter for cutting predetermined shaped pieces from a sheet of thin material, such as paper.

2. Background Information

Cutting devices and tools have been in use for many years to cut various materials, such as hair, paper and cloth. These cutting devices often are sharp edged devices, such as knives and razor blades. While knives and razor blades may allow the user to cut continuously, the danger inherent in using such sharp devices is well known, and such instruments often are not appropriate for children. These sharp objects also may dull over time with continued use and thus their effectiveness in precision cutting diminishes over time. Another concern with knives and razor blades is that if the material to be cut is placed on a substrate, such as a floor or table, the underlying substrate may be damaged during the cutting process.

Scissors are another type of cutting device, which overcome some of the above shortcomings associated with knives and razor blades. Known types of scissors include blades pivotally attached to handles or finger and thumb loops. The scissors employ a shearing action between blades that are positioned on opposite sides of the material to be cut. As the blades are pressed together, typically by operating the handles or finger loops, the material is cut or separated by the shearing action of the blades.

The effectiveness of scissors is dependent upon the user who manually operates and controls the cutting movements. Thus, some scissors may not be suitable in certain situations, such as when precision cutting of a material to a predetermined shape is required. This is particularly the case when the cut material is to be inserted into another device where a close fit is desired. For example, in the mobile phone industry, there is an increasing trend to personalize the mobile phone to suit the user's current mood, clothes, etc. One such product allows the user to choose an image, such as a photograph or picture from a magazine, cut it to the desired shape, corresponding to the back of the phone, with scissors using a template. The cut material may then be inserted only into the back cover of the mobile phone. While scissors may accomplish the cutting task, the accuracy of the cutting and thus resultant fit is dependent on the user. This may result in jagged edged cutting or cutting of the material into too large or too small of a shape, thereby damaging the aesthetic look. Moreover, the material may even be completely miscut to the point that it is no longer suitable for its intended function.

SUMMARY OF THE INVENTION

There is a desire to provide an improved cutter, which is efficient and easy to use, and can accurately and repeatedly cut thin material, such as paper, to a predetermined shape having intricate patterns. There also is a desire to provide an improved cutter, which is inexpensive to manufacture, lightweight, compact and able to be operated by adults and older children. There also is a desire to provide a method for assembling such a cutter, as well as a desire to provide a method of repeatedly and accurately cutting thin material, such as paper, into predetermined shapes having intricate patterns.

In accordance with one aspect of the present invention, a cutter for cutting a predetermined shaped piece from a material is provided. The cutter comprises a middle, rigid cutter member; and an outer, flexible non-cutting jaw member. The jaw member comprises a pair of elongated arms, a first arm and a second arm, which are joined together at a connected end. The cutter may further comprise an attachment member for attaching the connected end of the non-cutting jaw member to the middle, rigid cutter member.

In accordance with another aspect of the present invention, a two-part cutter for cutting a predetermined shaped piece from a material is provided comprising: a middle, rigid cutter member; and an outer, flexible non-cutting jaw member. The middle, rigid cutter member comprises a flat, elongated body extending in its direction of elongation from a rear end to a front end, and extending laterally left and right. The middle, rigid cutter member also has a first side, a second side, and a protruding attachment member at its rear end. The outer, flexible non-cutting jaw member comprises a pair of elongated arms, a first arm and a second arm, which are joined together at a connected end. The connected end includes an aperture into which the protruding attachment member of the middle, rigid cutter member is inserted.

In accordance with one method of the present invention, a method of assembling a cutter is provided. The method comprises attaching an attachment member of a middle, rigid cutter member to an outer, flexible, non-cutting jaw member. The outer, flexible, non-cutting jaw member comprises a first arm and a second arm, which are connected at a connected end, wherein the attachment member is attached at the connected end.

BRIEF DESCRIPTION OF THE DRAWINGS

The foregoing aspects and other features of the present invention are explained in the following description, taken in connection with the accompanying drawings, wherein.

DETAILED DESCRIPTION

Figure 1:
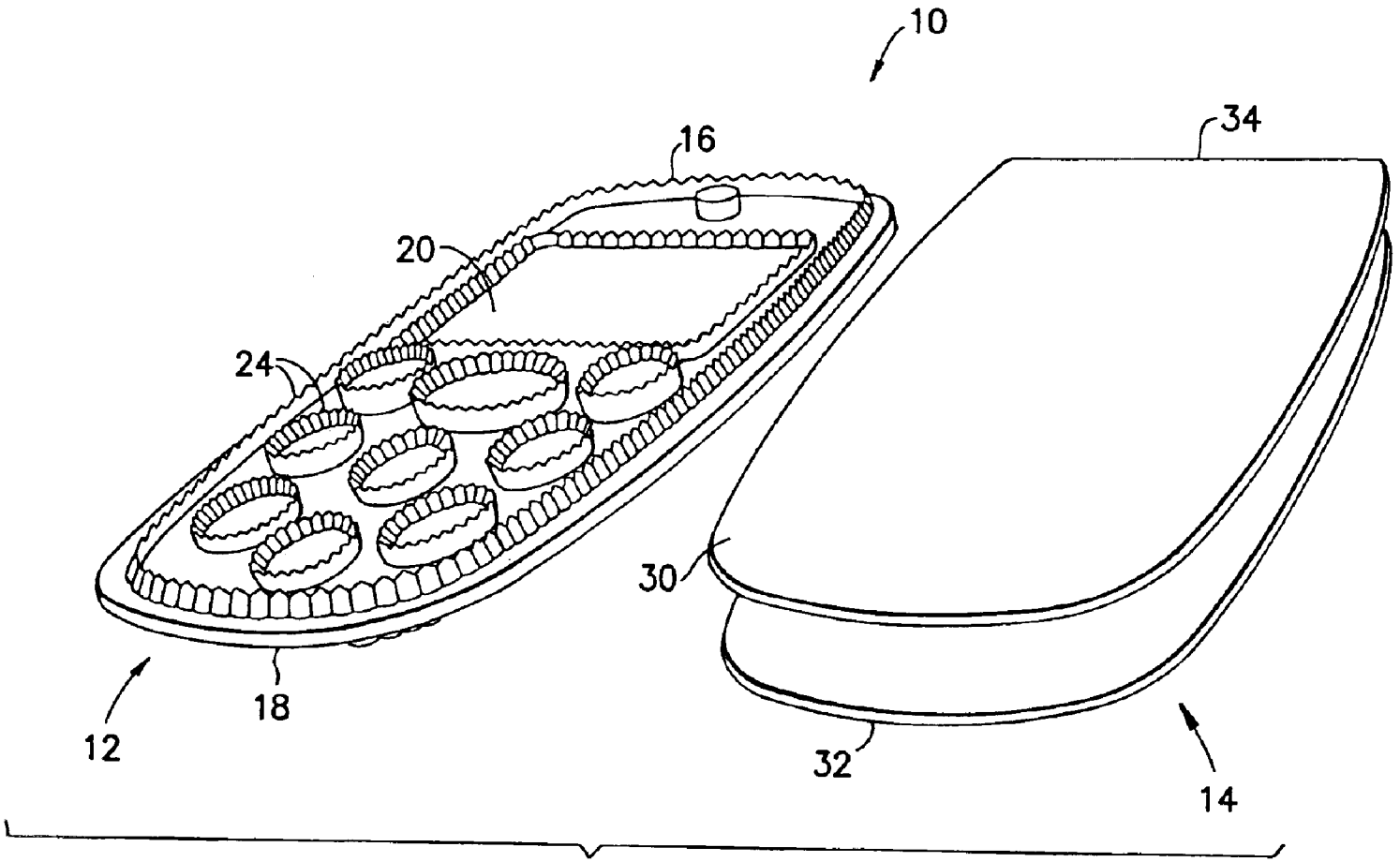
FIG. 1 is a perspective view of a cutter incorporating features of the present invention.

Referring to FIG. 1, there is shown a perspective view of an embodiment of a cutter 10 incorporating features of the present invention. Although the present invention will be described with reference to the embodiment shown in the Figures, it should be understood that the present invention can be embodied in many alternate forms of embodiments. For example, while the embodiment shown in the Figures relates to cutting paper templates, which then may be inserted under clear front and back covers of a portable or mobile phone for aesthetic purposes, the cutting of various other predetermined shaped material for other applications is contemplated by the present invention. In addition, any suitable size, shape or type of elements or materials may be used.

The cutter 10 generally comprises two main parts, a middle, rigid cutter member 12 and an outer, flexible non-cutting jaw member 14. This two-part embodiment allows the cutter 10 to be easily assembled, manufactured and operated, thereby providing an advantage over cutting tools employing numerous parts for manufacture and assembly. However, in alternate embodiments, the cutter 10 could comprise additional or alternative components.

In the embodiment shown, best seen in FIGS. 1–5, the outer, flexible jaw member 14 is separable from the middle cutter member 12. During operation of this embodiment, the outer, flexible jaw member 14 is affixed to one end of the middle cutter member 12. In alternate embodiments, the outer, flexible jaw member 14 might not be separable from the middle cutter member 12, as described below.

The middle cutter member 12 preferably comprises a flat elongated body extending in its direction of elongation from a rear end 16 to a front end 18, and extending laterally left and right. The middle cutter member 12 also has a first side 20 and a second side 22. The first side 20 comprises a plurality of cutting ribs 24 protruding from the first side 20 in a first predetermined pattern. The second side 22 of the middle cutter member 12 comprises a plurality of cutting ribs 26 protruding from the second side 22 in a second predetermined pattern.

The middle cutter member 12 may be of any suitable size, shape and thickness. Preferably, the middle cutter member 12 is a thin, flat member having a thickness between about 1 mm about 3 mm, excluding the height of the cutting ribs 24, 26.

Figure 2:
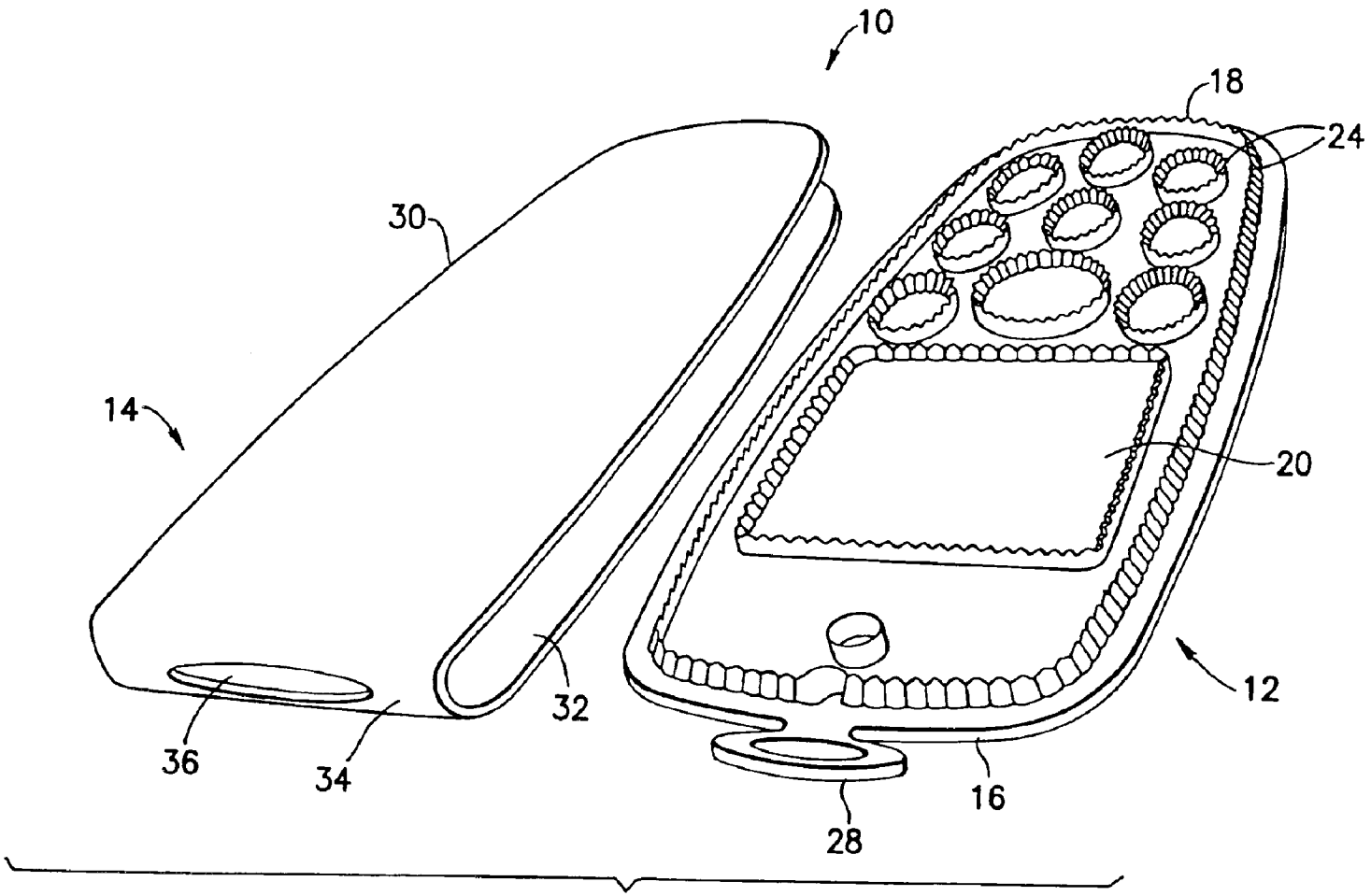
FIG. 2 is a perspective view of the cutter of FIG. 1, showing an attachment mechanism.
Figure 3:
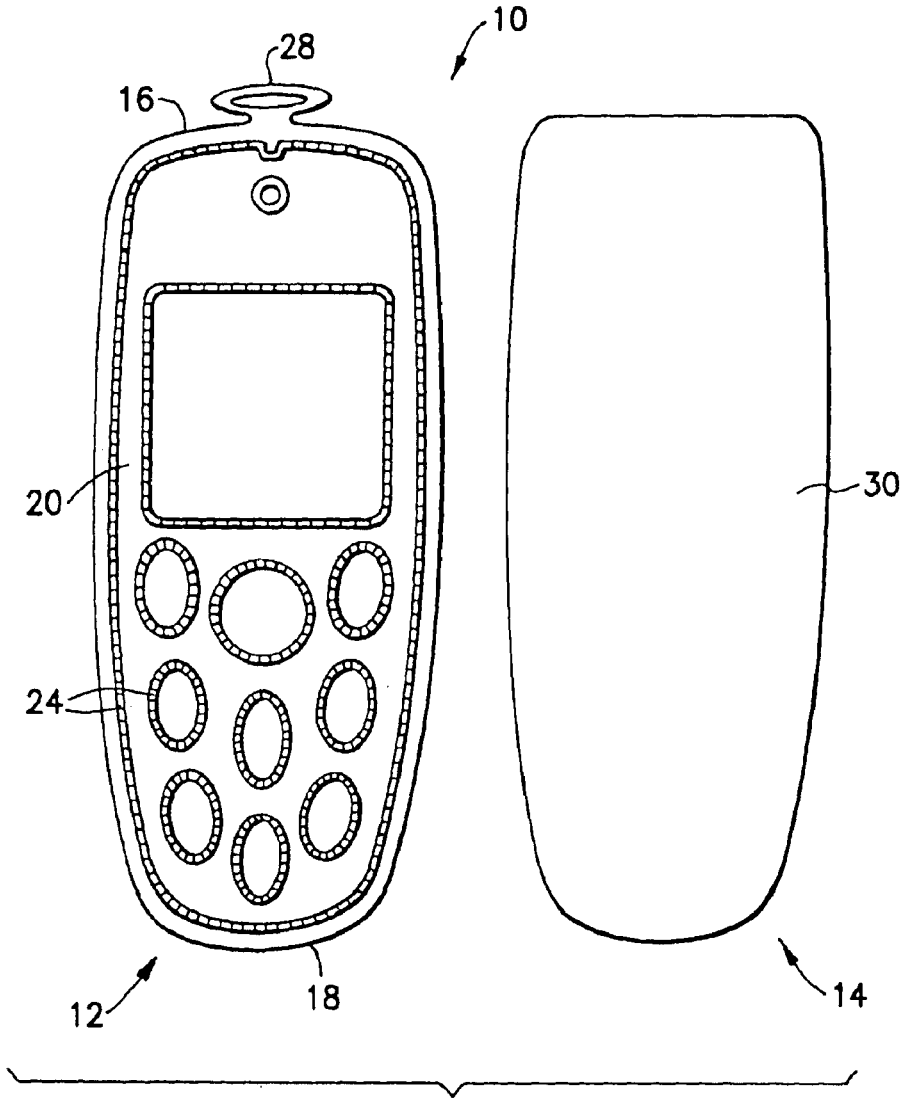
FIG. 3 is a top view of the first side of the middle, rigid cutting member, and the first arm of the outer, flexible jaw member of FIG. 1.

In the embodiment shown in the Figures, the cutter 12 is illustrated for producing paper cut-outs to be inserted under the front and back covers of a mobile phone. Thus, for convenience of the user and for cost savings, the outer dimensions of the middle cutter member 12 are shown as corresponding to slightly larger than a mobile phone to which the cut-outs will be applied. In this embodiment, the cutting ribs 24 are positioned on the first side 20 in a predetermined pattern to correspond with features on the front of a mobile phone. In particular, as shown in FIGS. 1–3, a connecting row of cutting ribs 24 is provided on the first side 20 which corresponds to outer dimensions of a mobile phone front cover to which it is applied. Similarly, cutting ribs 24 are provided in approximately circular or rectangular patterns so that upon application of the cut-out to the mobile phone, phone features such as the display screen, key pads or other openings and features are readily visible to the user.

The cutting ribs 24 of the first side 20 may be of any suitable shape, height, thickness and sharpness, depending upon the type of material to be completely or partially cut. For example, the cutting ribs 24 or teeth may be between about 1 mm and about 2.5 mm in height and have a thickness at the bottom of between about 0.5 mm to about 2 mm for cutting paper or other similar thin material. The top or portions of the cutting ribs 24 may be triangular in shape to facilitate the cutting action, but other suitable shapes, including but not limited to square, rectangular and circular, also are contemplated by the invention. For example, the cutting ribs 24 may comprise a line of extended cylinders having diameters of about 0.5 mm, each separated by about 0.5 mm. This embodiment is particularly advantageous for creating partial cuts or perforations in a material without the use of sharp edges on cutting ribs 24, 26. The material having the desired shape may be easily and cleanly pushed or torn out by the user.

Figure 4:
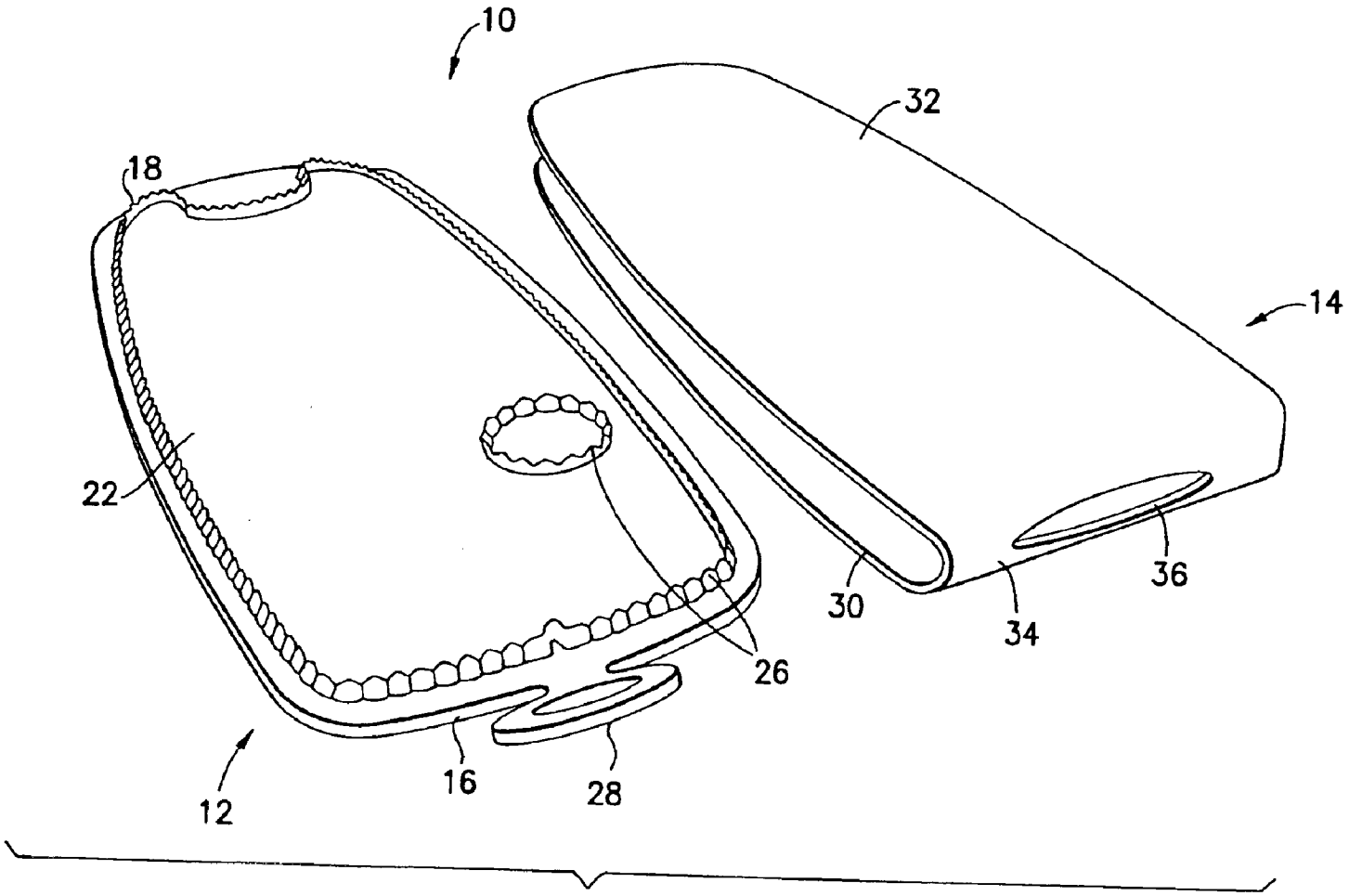
FIG. 4 is a perspective view of the cutter of FIG. 1, showing the second side of middle, rigid cutting member.
Figure 5:
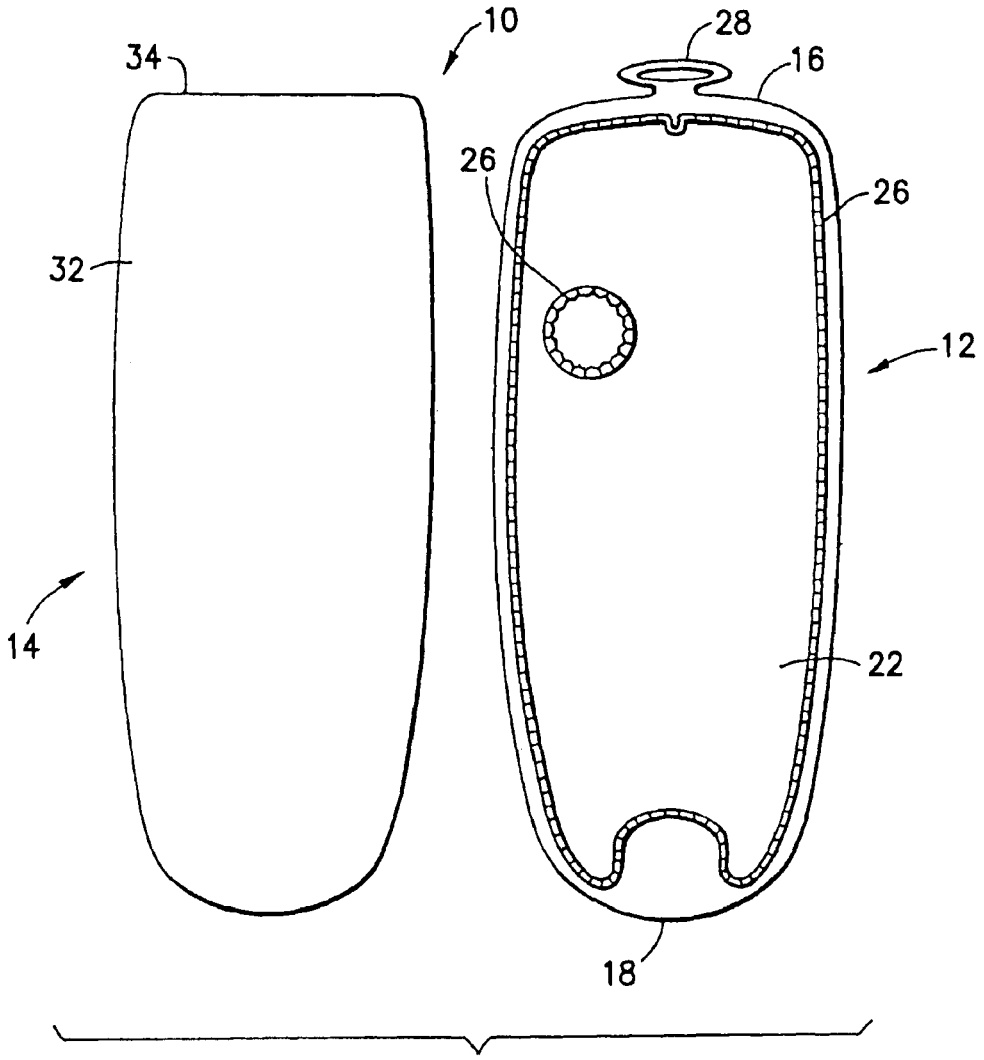
FIG. 5 is a top view of the second side of the middle, rigid cutting member and the second arm of the outer, flexible jaw member of FIG. 1.
Figure 6:
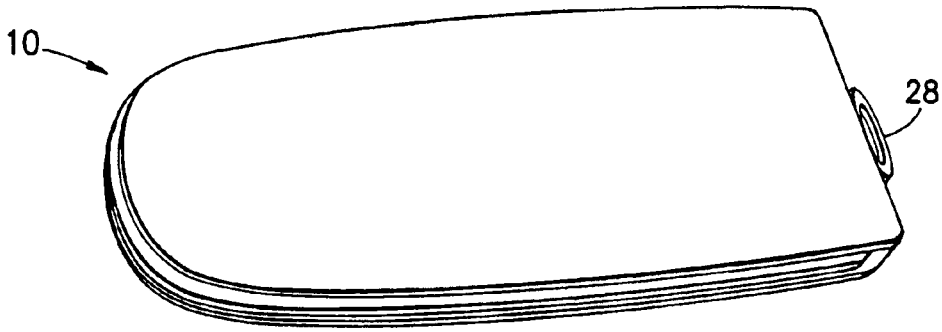
FIG. 6 is a perspective view of the cutter of FIG. 1 in the closed position.
Figure 7:
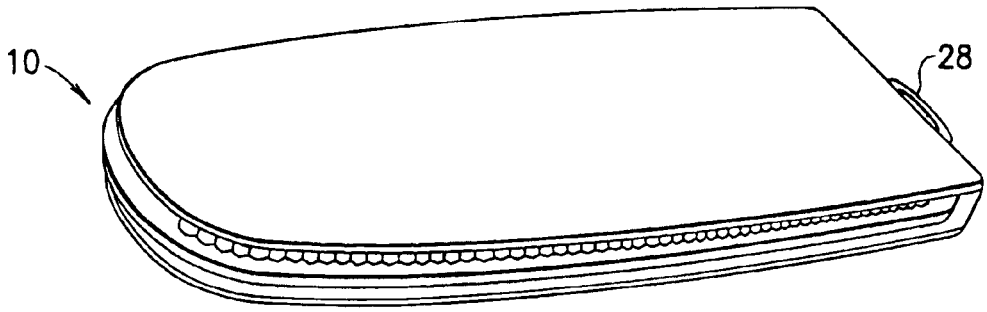
FIG. 7 also is a perspective view of the cutter of FIG. 1 in the closed position and showing cutting ribs.

In the embodiment shown in the Figures, cutting ribs 26 are positioned on the second side 22 of the middle cutter member 12 in a predetermined pattern to correspond with features on the back of a mobile phone. In particular, as shown in FIG. 4, a connecting row of cutting ribs 26 is provided on the second side 22 which corresponds to outer dimensions of a mobile phone back cover to which it is applied. Similarly, as shown in FIGS. 4–5, cutting ribs 26 are provided in patterns so that upon application of the cut-out to the mobile phone, desired features of the back of the phone are readily exposed. The cutting ribs 26 may otherwise be described as above with respect to the cutting ribs 24. An advantage of the foregoing is that the predetermined patterns of the cutting ribs 24 and 26 can be tailored so that the resultant cut material has the exact dimensions and shape desired. This is particularly advantageous if the resultant material is to be inserted into another device where a close fit is desired.

In alternate embodiments, the middle member 12 might have apertures therein. These openings may be of any suitable desired shape, size and location on the middle member 12. For example, the openings may be randomly arranged, hectagonal, honeycomb, triangular, etc., and be located such that they do not interfere with the functioning of the ribs 24, 26. This feature may decrease the weight of the cutter 10, as well as decrease manufacturing cost. Such openings may be particularly useful if a pattern on the first side 20 is the same as a pattern on the second side 22.

The middle cutter member 12 may be made out of any suitable rigid material, such as a hard plastic material, so that the member 12 is a hard, non-flexible body. For example, the member 12 may include a polymeric material, a composite material, a metal, metal alloy, etc. Preferably, the middle cutter member 12, including its cutting ribs 24 and 26, comprises plastic, such as injection molded plastic. Alternatively, the cutting ribs 24 and 26 may be made out of a different material, such as metal, than the rest of the middle cutter member 12.

In an alternate embodiment, the cutting ribs 24 and 26 each may be a continuous cutting mechanism, such as a blade, instead of the multiple rib or teeth-like protrusions shown in the Figures. The sharpness of the cutting ribs 24 and 26 depends on the material desired to be cut, as well as the desired type of cut. For example, any material which readily may be completely or partially cut by the cutter 10 is contemplated by the invention and includes, but is not limited to paper, aluminum foil, etc. The sharpness of the cutting ribs 24 and 26 may be just sharp enough to provide a complete cut through the desired material during operation of the cutter 10, if a complete cut is desired. Alternatively, the cutting ribs 24 and 26 may be just sharp enough to provide perforations or a partial cut through the desired material, which can easily and cleanly be pushed or torn out by the user, if a complete cut is not desired. The cutting ribs 24 and 26 should not be excessively sharp so as to create an unnecessary danger to the user or be able to pierce through the material and into the outer, flexible jaw member 14 thereby damaging the jaw member 14 during operation. In a further alternate embodiment, if the material desired to be cut is a thicker, more durable material such as leather, cardstock, vinyl, etc., and it is not desired to employ sharp edges on ribs 24, 26, which would completely or partially cut through the material, the cutter 10 may be advantageously employed to leave marks on the material in the desired pattern. In this case, ribs 24, 26 suitable for marking could be employed and then the material pattern may be cut out with traditional cutting tools by following the patterned markings.

The middle, rigid cutter member 12 also may include an attachment member 28 for attaching the middle member 12 to the outer, flexible jaw member 14. The attachment member 28 may be an elongated protrusion extending from the rear end 16 of the middle cutter member 12, as shown in FIG. 2, which can easily be secured to the outer, flexible jaw member 14. However, any suitable attaching mechanism is contemplated for the attachment member 28. In alternate embodiments, the attachment member 28 also might not be an integral part of cutter member 12, as described below.

While the middle cutter member 12 has been described above with respect to the cutting of paper cut-outs for interaction with the front and back covers of a mobile phone, it should be appreciated that middle cutter member 12 may be of different shape, size and thickness and including cutting ribs 24 and 26 in other intricately shaped, predetermined patterns. Thus, another advantage of the present invention is that various middle, cutter members 12 having different patterns thereon may be interchanged and used with the outer, flexible jaw member 14. For example, the middle cutter member may include predetermined patterns to create cut out materials for applications to other portable phones, lap top computers, PDAs and other similar devices for aesthetic purposes. Advantageously, the cutter 10 may even include predetermined patterns so that it may be employed in non-electronic fields. For example, in alternate embodiments, the cutter 10 may be used to create various shapes such as hearts, stars, trees, etc. for various applications. Applications may include, but are not limited to, letters, holiday greeting cards and decorations such as aluminum foil cut outs.

In the embodiment shown in the Figures, the outer, flexible jaw member 14 comprises a pair of elongated arms, a first arm 30 and a second arm 32. The arms 30, 32 are joined together at a connected end 34, as shown, for instance, in FIG. 2. Thus, in the embodiment shown, the arms 30, 32 each comprise an elongated body extending in its direction of elongation from the connected end 34 to the front end and laterally left and right. As also shown in FIG. 2, the side view of the jaw member 14 illustrates a one-piece U shaped form. The outer, flexible jaw member 14 may be of any suitable size and thickness. For example, the flexible, jaw member 14 may be a thin member having a thickness between about 0.5 mm and about 2 mm depending upon its material.

In the embodiment shown in the Figures, best seen in FIGS. 6–9 where the cutter 10 is in the closed position, the outer dimensions of the outer, flexible jaw member 14 are shown as being approximately or slightly larger than that of the middle cutter member 12. Thus, the outer, flexible jaw member 14 may envelop the middle, rigid cutter member 12 or may loosely fit around member 12.

In alternate embodiments, the member 14 could have other sizes and shapes. For example, the outer, flexible jaw member 14 may be split in two separate pieces, wherein the first arm 30 is attached or affixed to one end of the middle cutter member 12 and the second arm is attached or affixed to the other end of the middle cutter member 12. Any suitable attaching mechanism, including those described herein with respect to attachment member 28, might be employed.

The outer, flexible jaw member 14 may comprise any suitable flexible material, such as a soft plastic material. Suitable materials may include, but are not limited, to silicone, rubber and PVC. Preferably, the outer, flexible jaw member 14 is comfortable to the touch and soft to absorb pressure of the ribs during operation of the cutter 10. Additionally, the member 14 should be durable enough to resist being pierced by the ribs, 24 and 26 during operation of the cutter 10. The member 14 may comprise a material that allows it to conform around the ribs 24 or 26 during operation of the cutter 10. The flexible jaw member 14 also may comprise a material such as leather, denim or similar fabrics. Leather may be particularly advantageous because of its durability.

Accordingly, an advantage embodiment of the present invention is that cutting of material into predetermined shapes and patterns may be accomplished by use of a combination of hard and soft parts of a cutter.

Figure 8:
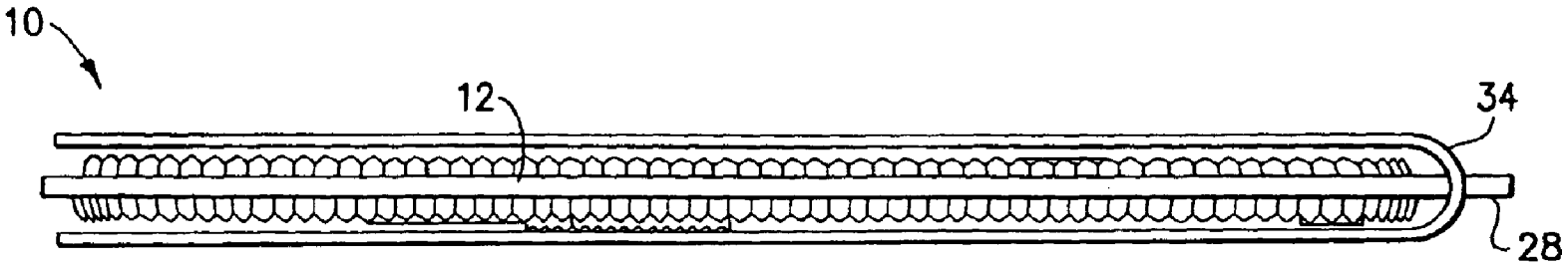
FIG. 8 is a side view of FIG. 7, showing the cutting ribs of both sides of the middle cutter member.

The outer, flexible jaw member 14 also may include an aperture 36, as shown in FIG. 2, into which the attachment member 28 may be inserted for operation of the cutter 10. FIG. 8 is a side view of the cutter 10 showing an embodiment of attachment 28 protruding through an aperture 36. The shape and size of the aperture 36 corresponds with that of the attachment member 28 so that the attachment member 28 may be easily and securely inserted therein.

In other embodiments and as an alternative to attachment member 28 and aperture 36, the middle cutter member 12 and the outer, flexible jaw member 14 may be attached in other ways. For example, one or more connecting poles or pins may be inserted through the flexible jaw member 14, which then may be pressed to fix the middle cutter member 12 in place. These connecting poles may be made of any suitable, shape, size and thickness dependent upon the size and shape of the cutter 10. The connecting poles also may be of a material as described for that of the middle, rigid cutter member 12. Alternately, the attachment member 28 may be a separate joining member, such a loop made out of any suitable material, a staple, etc.

Figure 9:
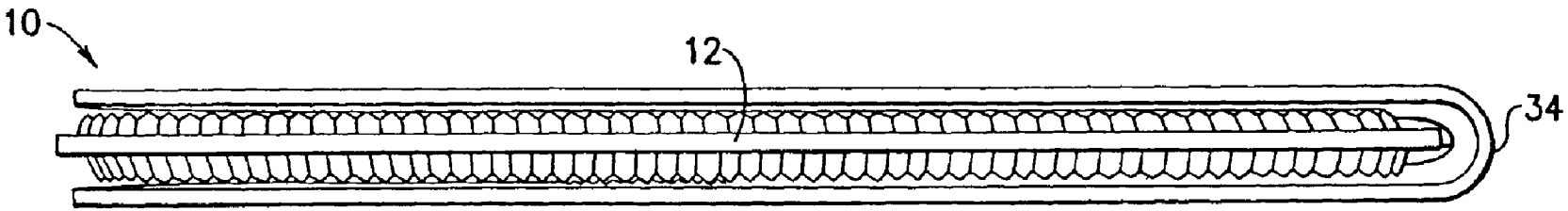
FIG. 9 is a side view of FIG. 7, showing an alternative embodiment, wherein the outer, flexible jaw member and the middle, rigid cutter member are not attached to each other.

In an alternate embodiment and as shown in FIG. 9, the outer, flexible jaw member 14 and middle, flexible member 12 might not be connected to each other. In this embodiment, the first arm 30 and second arm 32 may envelop the middle, cutter member 12.

As illustrated in FIGS. 10–13, operation of the cutter 10 involves the selection of a middle cutter member 12. In the embodiment shown, the middle cutter member 12 has cutting ribs 24 and 26 to provide a cut-out for application with a mobile phone front and back cover, respectively. However, in alternate embodiments, a middle cutter member 12 having cutting ribs on only the first side 20 or only on the second side 22 may be selected and in various shapes and patterns depending upon the application, as described above. For example, if a mobile phone only needed one cut-out for the front or back of the phone, such a single-sided cutter could be employed in combination with both or only one of arms 30, 32.

Figure 10:
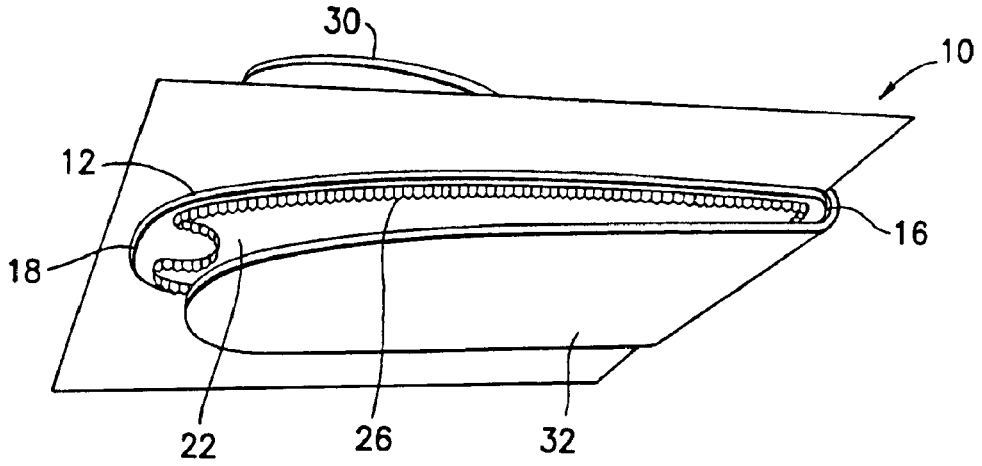
FIG. 10 is a perspective view of an embodiment of the cutter of the present invention with a sheet of paper in the receiving area between the first arm and the first side of the middle cutter member.
Figure 11:
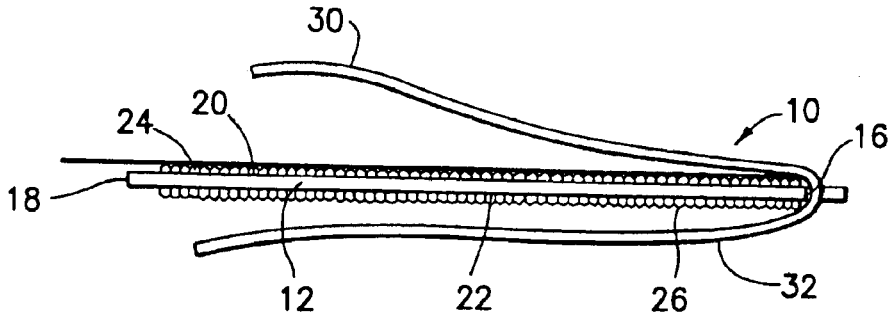
FIG. 11 is a side view of FIG. 10.
Figure 12:
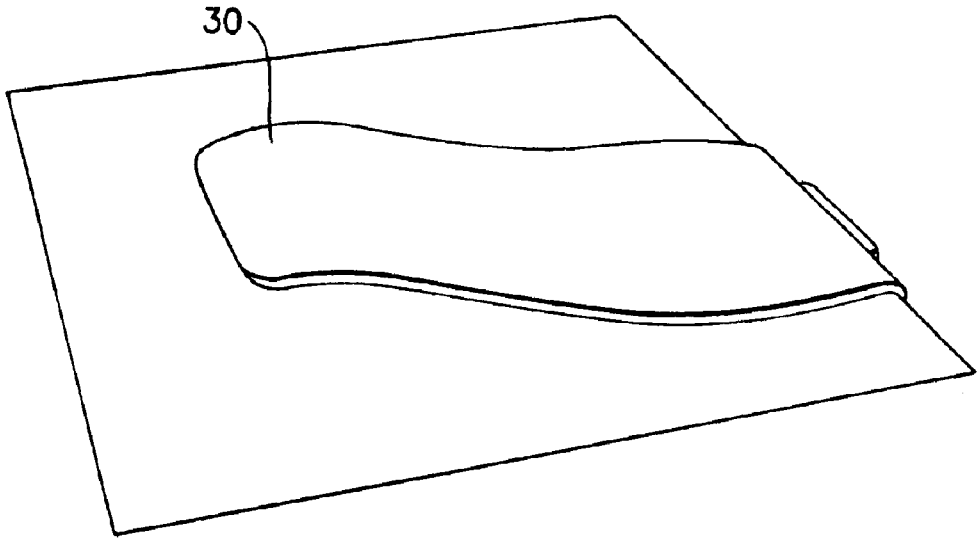
FIG. 12 shows a top perspective view of FIG. 11.
Figure 13:
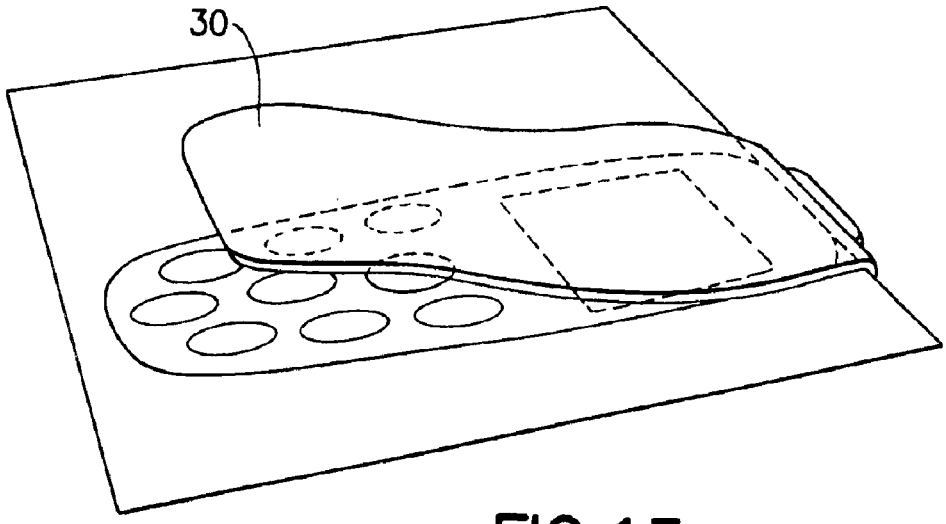
FIG. 13 shows the cut paper template of FIGS. 10–12 after pressing.

The middle, rigid cutter member 12 may then be inserted into the outer, flexible jaw member 14 for attachment thereto. The cutter 10 is thus formed, which is able to repeatedly cut predetermined shapes in thin material, such as paper, by simple manipulation by a user. For example, a piece of paper may be inserted into the receiving area between first side 20 of the middle, cutter member 12 and the first arm 30, as shown in FIG. 10. The first arm 30 and the second arm 32 may then be squeezed together manually by, for example, applying pressure to the upper arm 30 in this case or both arms 30, 32. Alternatively, the cutter 10 may be placed on a solid surface and pressure applied downward to the cutter 10. The cutter 10 may even be placed on the floor and stepped on to provide pressure to the outer, flexible jaw 14. The manual pressing motion causes the cutting ribs 24 to pierce the material in the desired pattern. As shown in FIG. 13, the cut paper has the desired perforations, which may be easily removed by the user for subsequent use.

Alternatively, the sheet of material may be placed in the receiving area between the second side 22 of the middle cutter member 12 and the second arm 32. The device may then be manually operated as similarly described above. Advantageously, it is contemplated that material may be placed in the receiving area between the first arm 30 and the first side 20, as well as in the receiving area between the second arm 32 and second side 22 so that during operation both sheets of material may be simultaneously and efficiently cut. For example, the user may squeeze together both the first and second arms 30, 32, place the cutter 10 on a hard surface and apply pressure thereto or even step on the cutter 10. In alternate embodiments, more than one sheet of material might be inserted in the receiving area between the first arm 30 and first side 20, and more than one sheet of material might be inserted in the receiving area between the second arm 32 and second side 22.

An advantage of the present invention includes providing a cutter that is efficient and easy to use, and can accurately and repeatedly cut thin material, such as paper, to a predetermined shape having intricate patterns. Another advantage is that cutter 10 may be inexpensive to manufacture, lightweight, compact and may be operated by adults and older children. Yet another advantage of the present invention is providing a method of repeatedly and accurately cutting thin material, such as paper, into predetermined shapes having intricate patterns.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A cutter for cutting a predetermined shaped piece from a material, comprising:

a middle, rigid cutter member having a first side and a second side;

an outer, flexible non-cutting jaw member comprising a pair of elongated arms, a first arm and a second arm, which are joined together at a connected end; and an attachment member for attaching the connected end of the non-cutting jaw member to the middle, rigid cutter member;

the cutter further comprising a first receiving area and a second receiving area, wherein the first receiving area is located between the first arm and the first side of the middle, rigid cutter member and the second receiving area is located between the second arm and the second side of the middle, rigid cutter member;

wherein the cutter is for cutting a predetermined shaped piece from a material.

2. The cutter of claim 1, wherein the cutter comprises two separable and connected parts.

3. The cutter of claim 1, wherein the middle, rigid cutter member comprises a flat elongated body extending in its direction of elongation from a rear end to a front end, and extending laterally left and right and having the first side and the second side.

4. The cutter of claim 3, wherein the first side comprises a plurality of cutting ribs in a first predetermined pattern.

5. The cutter of claim 3, wherein the second side comprises a plurality of cutting ribs in a second predetermined pattern.

6. The cutter of claim 3 wherein the first side comprises a plurality of cutting ribs in a first predetermined pattern, and the second side comprises a plurality of cutting ribs in a second predetermined pattern.

7. The cutter of claim 6, wherein the cutting ribs in the first predetermined pattern correspond to features on a front face of a mobile phone, and the cutting ribs in the second predetermined pattern correspond to features on a back face of a mobile phone.

8. The cutter of claim 3, wherein the middle, rigid cutter member has a thickness between about 1 mm and about 3 mm.

9. The cutter of claim 1, wherein at least one of the first side and the second side of the middle, rigid cutter member comprises a plurality of protruding ribs.

10. The cutter of claim 9, wherein the protruding ribs comprise portions having a shape selected from the group consisting of square, rectangular, circular and triangular.

11. The cutter of claim 1, wherein at least one of the first side and the second side of the middle, rigid cutter member comprises a continuous cutting blade.

12. The cutter of claim 1, wherein the rigid, middle cutter member comprises injection molded plastic.

13. The cutter of claim 1, wherein the middle, rigid cutter member comprises a material selected from the group consisting of metal, metal alloy, composite and polymeric material.

14. The cutter of claim 1, wherein the attachment member protrudes from one end of the middle, rigid cutter member.

15. The cutter of claim 14, wherein the connected end of the outer, flexible jaw member includes an aperture into which the protruding attachment member is inserted.

16. The cutter of claim 1, wherein the outer, flexible jaw member comprises silicone.

17. The cutter of claim 1, wherein the outer, flexible jaw member comprises a material selected from the group consisting of leather, fabric, plastic, polyvinyl chloride and rubber.

18. The cutter of claim 1, wherein the first arm and the second arm are about the same size and thickness.

19. The cutter of claim 1, wherein the material comprises paper.

20. The cutter of claim 9, wherein the protruding ribs comprise a plurality of cylinders having diameters of about 0.5 mm and separated from each other by about 0.5 mm.

21. The cutter of claim 1, wherein the middle, rigid cutter member has a hardness greater than the hardness of the outer, flexible jaw member.

22. A two-part cutter for cutting a predetermined shaped piece from a material, comprising:

a middle, rigid cutter member comprising a flat, elongated body extending in its direction of elongation from a rear end to a front end, and extending laterally left and right, and having a first side and a second side; the middle, rigid cutter member comprising a protruding attachment member at the rear end; and an outer, flexible non-cutting jaw member comprising a pair of elongated arms, a first arm and a second arm, which are joined together at a connected end, wherein the connected end includes an aperture into which the protruding attachment member of the middle, rigid cutter member is located;

the cutter further comprising a first receiving area and a second receiving area, wherein the first receiving area is located between the first arm and the first side of the middle, rigid cutter member and the second receiving area is located between the second arm and the second side of the middle, rigid cutter member;

wherein the cutter is for cutting a predetermined shaped piece from a material.

23. A method for cutting a predetermined shaped piece from a material, comprising the steps of:

inserting the material into at least one receiving area of the cutter of claim 22;

applying pressure to the cutter so that the material is at least partially cut into the predetermined shaped piece.

24. A method of assembling a cutter comprising: attaching an attachment member of a middle, rigid cutter member to an outer, flexible, non-cutting jaw member, the jaw member comprising a first arm and a second arm, which are connected at a connected end; wherein the attachment member is attached at the connected end; the cutter further comprising a first receiving area and a second receiving area, wherein the first receiving area is located between the first arm and a first side of the middle, rigid cutter member and the second receiving area is located between the second arm and a second side of the middle, rigid cutter member.

25. A cutter, comprising:

a middle, rigid cutter member having a first side and a second side;

a flexible non-cutting member adjacent the first side and the second side of the middle, rigid cutter member, the flexible non-cutting member having a first arm and a second arm;

wherein the middle, rigid cutter member includes ribs, which can cut or mark a predetermined shaped piece from a material; and the cutter further comprises a first receiving area and a second receiving area, wherein the first receiving area is located between the first arm and the first side of the middle, rigid cutter member and the second receiving area is located between the second arm and the second side of the middle, rigid cutter member.

26. A cutter comprising:

a rigid cutter member; and a flexible non-cutting member adjacent one side of the rigid cutter member and attached to the rigid cutter member;

wherein the rigid cutter member comprises ribs, which can cut or mark a predetermined shaped piece from a material; and the cutter is for cutting the material adjacent the flexible law member and the rigid cutter member with the cutting being accomplished with use of the flexible jaw member and the rigid cutter member.

27. A cutter for cutting a predetermined shaped piece from a material, comprising:

a middle, rigid cutter member comprising a flat elongated body extending in its direction of elongation from a rear end to a front end, and extending laterally left and right and having a first side and a second side, wherein the second side comprises a plurality of cutting ribs in a second predetermined pattern;

an outer, flexible non-cutting jaw member comprising a pair of elongated arms, a first arm and a second arm, which are joined together at a connected end; and an attachment member for attaching the connected end of the non-cutting jaw member to the middle, rigid cutter member;

wherein the cutter is for cutting a predetermined shaped piece from a material.

28. A cutter for cutting a predetermined shaped piece from a material, comprising:

a middle, rigid cutter member comprising a flat elongated body extending in its direction of elongation from a rear end to a front end, and extending laterally left and right and having a first side and a second side, wherein the first side comprises a plurality of cutting ribs in a first predetermined pattern, and the second side comprises a plurality of cutting ribs in a second predetermined pattern;

an outer, flexible non-cutting jaw member comprising a pair of elongated arms, a first arm and a second arm, which are joined together at a connected end; and an attachment member for attaching the connected end of the non-cutting jaw member to the middle, rigid cutter member;

wherein the cutter is for cutting a predetermined shaped piece from a material.

29. A cutter for cutting a predetermined shaped piece from a material, comprising:

a middle, rigid cutter member comprising a flat elongated body extending in its direction of elongation from a rear end to a front end, and extending laterally left and right and having a first side and a second side, wherein the first side comprises a plurality of cutting ribs in a first predetermined pattern, and the second side comprises a plurality of cutting ribs in a second predetermined pattern; the cutting ribs in the first predetermined pattern corresponding to features on a front face of a mobile phone, and the cutting ribs in the second predetermined pattern corresponding to features on a back face of a mobile phone;

an outer, flexible non-cuffing jaw member comprising a pair of elongated arms, a first arm and a second arm, which are joined together at a connected end; and an attachment member for attaching the connected end of the non-cutting jaw member to the middle, rigid cutter member;

wherein the cutter is for cutting a predetermined shaped piece from a material.

* * * * *

UNITED STATES PATENT AND TRADEMARK OFFICE

CERTIFICATE OF CORRECTION

PATENT NO. : 6,895,842 B2
DATED : May 24, 2005
INVENTOR(S) : Birgir Magnusson

It is certified that error appears in the above-identified patent and that said Letters Patent is hereby corrected as shown below:

Column 10,
Line 2, change “law” to -- jaw --.
Line 55, change “non-cuffing” to -- non-cutting --.

Signed and Sealed this

Sixteenth Day of August, 2005

JON W. DUDAS
*Director of the United States Patent and Trademark Office*